US010206851B1

(12) United States Patent
Gherdan, Jr. et al.

(10) Patent No.: US 10,206,851 B1
(45) Date of Patent: Feb. 19, 2019

(54) CHILD-RESISTANT, SENIOR-FRIENDLY PACKAGE

(71) Applicant: ANDERSONBRECON INC., Rockford, IL (US)

(72) Inventors: Victor Gherdan, Jr., Cherry Hill, NJ (US); Thomas Moyer, Davis, IL (US); Douglas Jahn, Jr., Cincinnati, OH (US); Jennifer McHale, East Hanover, NJ (US)

(73) Assignee: AndersonBrecon Inc., Rockford, IL (US)

( * ) Notice: Subject to any disclaimer, the term of this patent is extended or adjusted under 35 U.S.C. 154(b) by 0 days.

(21) Appl. No.: 15/725,302

(22) Filed: Oct. 5, 2017

(51) Int. Cl.
*A61J 1/03* (2006.01)
*B65D 75/36* (2006.01)
*B65D 5/20* (2006.01)

(52) U.S. Cl.
CPC ..... *A61J 1/035* (2013.01); *B65D 5/20* (2013.01); *B65D 75/367* (2013.01)

(58) Field of Classification Search
CPC ..... A61J 1/035; B65D 5/20; B65D 75/367; B65D 75/328; B65D 73/0092; B65D 5/4204
USPC ..... 206/536, 528, 530, 521, 531, 461; 229/125.125
See application file for complete search history.

(56) References Cited

U.S. PATENT DOCUMENTS 3,305,077 A 2/1967 Greif et al.
4,125,190 A * 11/1978 Davie, Jr. ..... B32B 3/28 206/532
4,537,312 A 8/1985 Intini
5,042,472 A 8/1991 Bunin
5,150,793 A 9/1992 Tannenbaum
D337,725 S 7/1993 Bunin
5,339,960 A 8/1994 Price
5,549,204 A 8/1996 Toren
6,659,280 B2 * 12/2003 Paliotta ..... B65D 75/327 206/469
6,675,972 B2 * 1/2004 Patterson ..... B65D 75/327 206/468
7,000,769 B2 2/2006 Killinger
7,201,274 B2 * 4/2007 Paliotta ..... B65D 75/327 206/531
7,331,460 B2 2/2008 Barndt et al.
7,337,906 B2 * 3/2008 Chang ..... B65D 75/327 206/531

(Continued)

*Primary Examiner* — Chun Cheung
(74) *Attorney, Agent, or Firm* — Howson & Howson LLP

(57) ABSTRACT

A child-resistant package is provided having a hollow carton with opposed front and rear walls and a separate blister card having a plurality of separate, spaced-apart hollow blister compartments contained therein. The front wall of the hollow carton comprising a structure including an exterior wall panel having a plurality of openings, gates, or pull tabs and an interior wall panel adhesively secured to the exterior wall panel. The interior wall panel of the front wall has a plurality of chads aligned between the openings and blister compartments. The rear wall of the hollow carton comprising a structure including an exterior wall panel having a plurality of separate, openings and an interior wall panel adhesively secured to the exterior wall panel. The interior wall panel of the rear wall having a plurality of break-away chads located directly between the blister compartments and the openings.

19 Claims, 17 Drawing Sheets

(56) References Cited

U.S. PATENT DOCUMENTS 7,464,818 B2 * 12/2008 Gherdan ..... B65D 83/0463 206/531
7,735,650 B2 * 6/2010 Zumbiel ..... B65D 83/0463 206/531
D623,948 S 9/2010 Levy
7,798,328 B2 9/2010 Hession
7,896,161 B2 * 3/2011 Reilley ..... B65D 75/327 206/462
7,967,143 B2 * 6/2011 Paliotta ..... B65D 5/4204 206/462
8,066,121 B2 11/2011 Sack et al.
8,079,475 B2 12/2011 McArthur et al.
8,091,708 B2 * 1/2012 Loftin ..... A61J 1/035 206/528
8,328,018 B2 12/2012 Sack et al.
8,746,454 B2 * 6/2014 Doucet ..... B65D 83/0463 206/531
2003/0209558 A1 11/2003 Cross
2005/0077203 A1 * 4/2005 Morita ..... B65D 75/327 206/531
2005/0274643 A1 12/2005 Arnold
2006/0027480 A1 * 2/2006 Buss ..... B65D 75/327 206/532
2006/0102512 A1 * 5/2006 Lo Duca ..... B65D 75/327 206/531
2006/0289328 A1 * 12/2006 Hession ..... B65D 75/327 206/531
2007/0056876 A1 * 3/2007 Jones ..... B65D 75/327 206/531
2007/0151894 A1 7/2007 Gherdan, Jr. et al.
2007/0221534 A1 * 9/2007 Intini ..... A61J 1/035 206/532
2007/0235367 A1 * 10/2007 Initini ..... A61J 1/035 206/531
2008/0078690 A1 * 4/2008 Zumbiel ..... B65D 83/0463 206/534
2008/0093252 A1 4/2008 Hession
2008/0202972 A1 8/2008 Prud'Homme
2008/0277311 A1 11/2008 Wang et al.
2009/0038982 A1 * 2/2009 Doucet ..... B65D 83/0463 206/531
2009/0107873 A1 4/2009 Cotton et al.
2009/0301924 A1 12/2009 Rondeau
2010/0084308 A1 4/2010 Rigby
2010/0108677 A1 * 5/2010 Loftin ..... A61J 1/035 220/265
2010/0193395 A1 * 8/2010 Mowery ..... B65D 83/0463 206/528
2010/0213097 A1 * 8/2010 Paliotta ..... B65D 5/4204 206/531
2011/0163156 A1 * 7/2011 Smith ..... B65D 83/0463 229/125.125
2011/0210036 A1 9/2011 Jones
2014/0305834 A1 10/2014 Knutson et al.
2014/0339121 A1 11/2014 Gelardi et al.

* cited by examiner

CHILD-RESISTANT, SENIOR-FRIENDLY PACKAGE

BACKGROUND

The present invention relates to a package for containing separate items, such as pills, tablets, doses of medicine, or the like, and more particularly, the present invention relates to a blister-in-carton package configuration providing child-resistant, senior-friendly dispensing properties.

By way of general example, paperboard packages including a blister card are disclosed by U.S. Pat. No. 7,896,161 B2 issued to Reilley et al., U.S. Pat. No. 8,066,121 B2 issued to Sack et al., and U.S. Pat. No. 8,328,018 B2 issued to Sack et al. and U.S. Patent Application Publication No. 2014/0305834 A1 of Knutson et al. which are assigned to the Applicant of the present application.

Although the above referenced paperboard packages may be satisfactory for their intended purpose, additional package designs able to provide desired dispensing properties and enabling cost efficient manufacture are desired.

BRIEF DESCRIPTION OF THE DRAWINGS

The present invention should become apparent from the following description when taken in conjunction with the accompanying drawings, in which.

DETAILED DESCRIPTION

Embodiments disclosed herein provide a carton used to house or contain a separately manufactured blister card. When assembled, the blister card is sealed within the carton to form a package, and tablets or the like held by the blister card may be independently dispensed from the package via the performance of a sequence of steps designed to provide a desired level of child-resistance whereby unintended persons, such as young children, are unable to perform the sequence of manipulations to dispense a tablet from the package.

According to embodiments, the package may achieve so-called F=1 child resistance standards. Child resistance ratings are determined on a scale ranging from F=1 through F=8. The "F" represents "harmful at" and the number represents the number of doses. For example, F=2 is "harmful at 2 doses." Thus, the more difficult it is for a child to access a product contained within a blister card package, the lower the child-resistance rating applied to the packaging. Products contained within packaging rated at F=1, i.e., harmful at one dose, should be very difficult for children to access. A blister card package that is to be used for distribution of potentially lethal pharmaceutical drugs or clinical trial drugs must pass the aforementioned federal guidelines prior to use. The child resistance rating determines the type of pharmaceutical drugs that can be distributed within each rating of packaging, i.e., a pharmaceutical drug that is harmful at one dose cannot be packaged in a blister card package that is rated F=2 through F=8.

First Embodiment of a Blister-in-Carton Package

Figure 5:
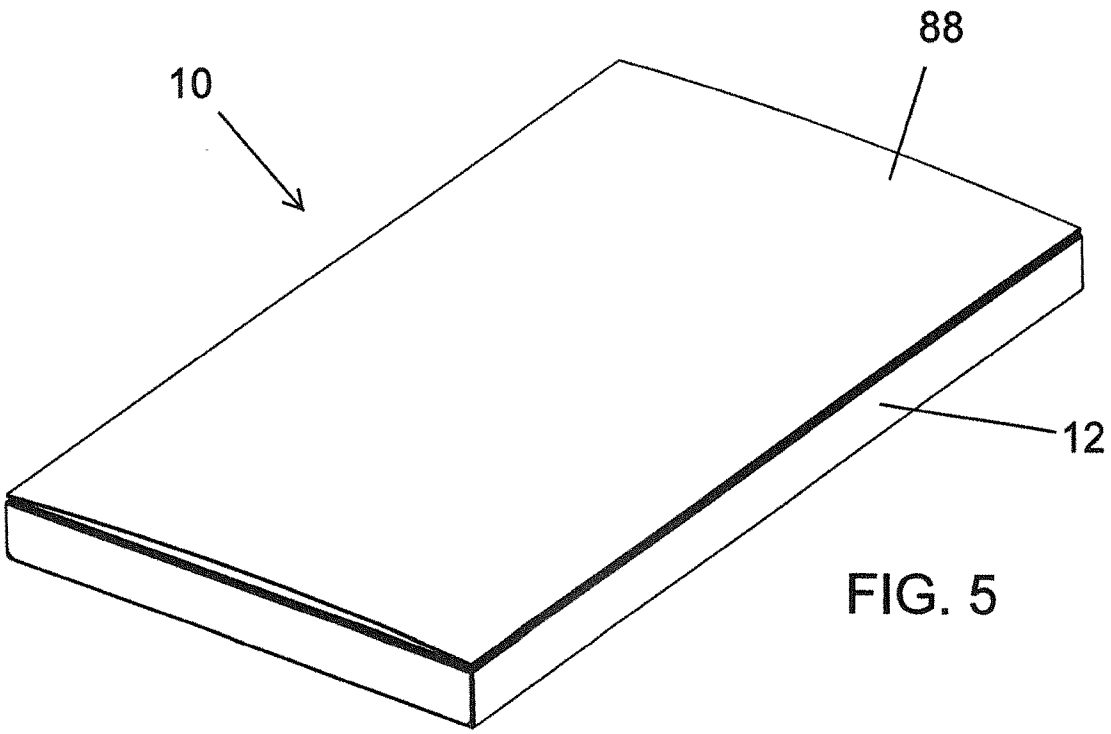
FIG. 5 is a perspective view of a fully assembled package with a cover flap thereof in a closed position according to the first embodiment.

According to a first embodiment, a fully assembled package 10, such as shown in FIG. 5, may be of a relatively-compact, thin, elongate, and/or of rectangular configuration. Of course, the package may be formed in other shapes and configurations.

Figure 2:
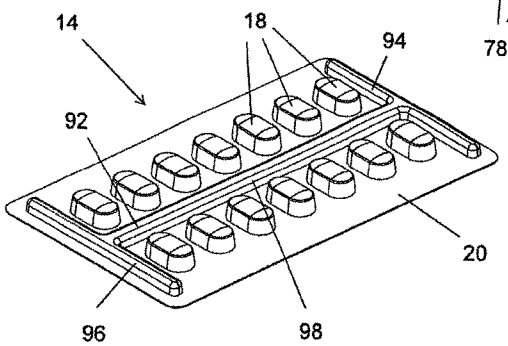
FIG. 2 is a perspective view of a blister card according to the first embodiment.

The package 10 includes a hollow carton 12 forming a protective case that is shaped to receive and house a separately-manufactured blister card 14 such as shown in FIG. 2. Typically, the package 10 is provided of a size that can be readily held in the hand of an intended end user and that contains a predetermined number of doses or tablets. By way of example, the blister card 14 in the illustrated embodiment is designed to contain fourteen separate tablets 16 in fourteen separate blister compartments 18. Of course, the number, shape, pattern, and size of blister compartments 18 and tablets 16 may be altered from that illustrated depending on the pharmaceutical drug being packaged.

The package 10 is structured such that tablets 16 can be readily dispensed from the package 10 via a sequence of manipulations by the fingers of an intended end user, such as a senior citizen. However, the structure of the package 10 and sequence of steps required to dispense a tablet 16 is such that the package 10 provides a desired level of child-resistance whereby unintended persons, such as young children, cannot perform the sequence of manipulations and dispense a tablet 16 from the package 10. The level of child resistance must be maintained not only relative to a new package containing a complete set of tablets, but also for a partially used package from which one or more tablets 16 may have already been dispensed.

The blister card 14 may be provided in various forms. In the illustrated embodiment, the blister card 14 is made from a generally planar card 20 molded in a manner forming a plurality of integral, separate, spaced-apart, upstanding blister compartments 18 providing a plurality of separate hollow compartments in which a tablet, pill or other small article 16 may be loaded. A backing may be applied to the rear of the card 20 to seal tablets 16 loaded on the blister card 14 in the upstanding blister compartments 18. The backing may be provided by a single layer of metal foil or the like.

The plurality of separate blister compartments 18 permit a tablet 16 to be dispensed from one compartment without disturbing the other blister compartments of the blister card 14 and the remaining tablets 16 stored on the blister card. The card 20 and blister compartments 18 may be formed or molded of a thermoplastic material that may be transparent. Of course, other materials and blister card configurations and structures may be used.

Figure 1:
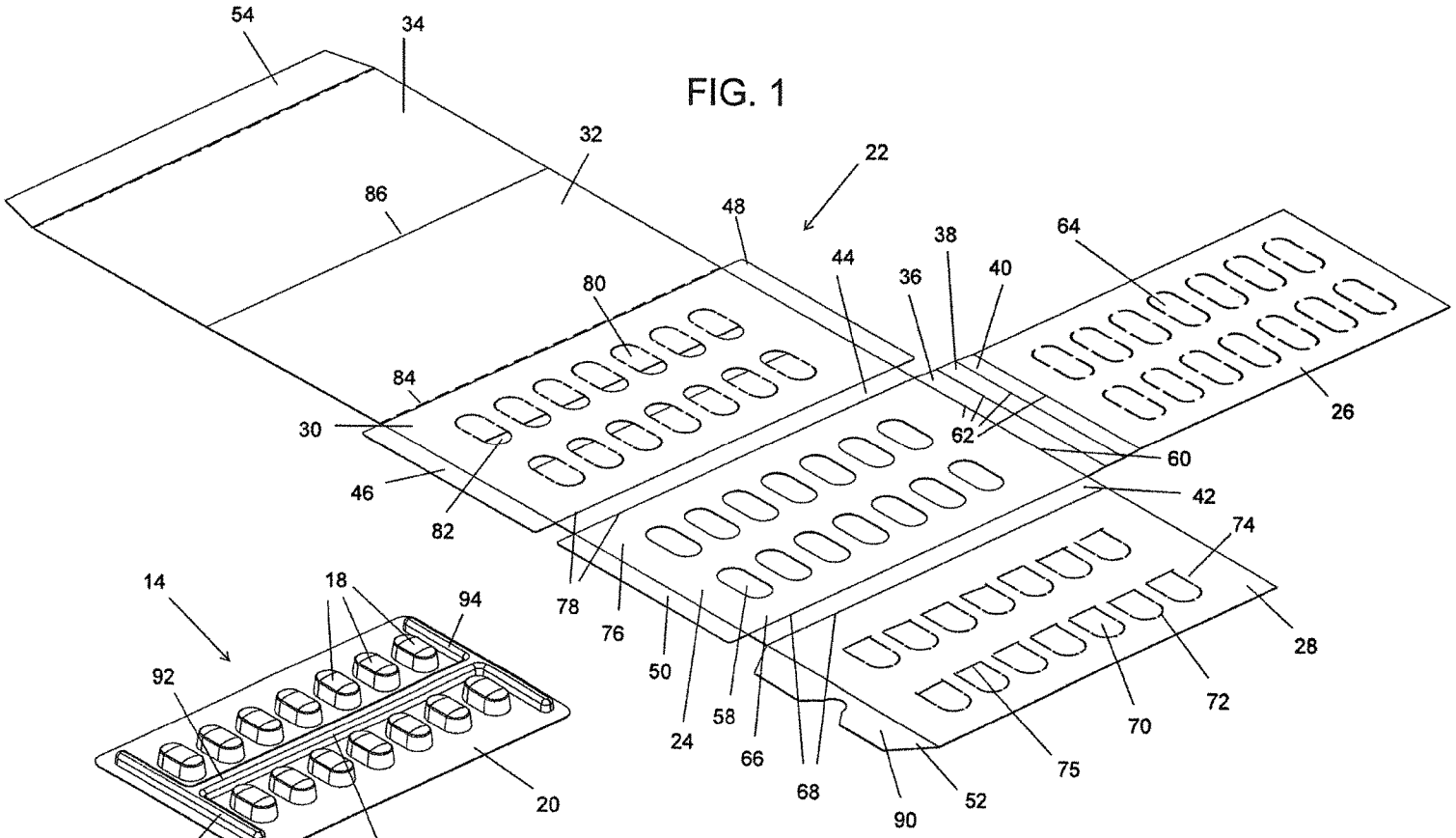
FIG. 1 is a perspective view of an unfolded carton blank used to form a carton according to a first embodiment.

A foldable sheet of material or carton blank 22 for use in forming the hollow carton 12 is shown in FIG. 1. The blank 22 may be made of a sheet of cardboard, paperboard, plastic, or the like. According to an embodiment, the blank 22 is formed from a single integral sheet of material having been cut, perforated, creased, etc., for instance, as shown in FIG. 1.

The blank 22 may include six relatively large major panels 24, 26, 28, 30, 32 and 34 and ten relatively-smaller minor panels 36, 38, 40, 42, 44, 46, 48, 50, 52 and 54. By way of example, a first major panel 24 may form a rear wall 56 of the fully assembled package 10 and may include a plurality of openings or cutouts 58. In the assembled package 10, each opening or cutout 58 is aligned directly behind one of the blister compartments 18 of the blister card 14 contained within the carton 12.

A second major panel 26 extends from an end 60 of the first major panel 24 with three minor panels 36, 38 and 40, and four fold lines or pre-formed creases 62 therebetween. The three minor panels, 36, 38 and 40, are folded to produce a so-called hollow false bottom within the carton 12 and to locate the second major panel 26 directly on top of the first major panel 24 thereby forming a double-walled rear wall of the carton 12. The double-layered rear of the carton 12 increases resistance to punctures and tears to the package 10. In addition, the layers are adhered together with an adhesive or the like to prevent separation or peeling of the layers. The false bottom provides support for the carton 12 from crushing, aides in keeping the blister card 14 aligned for efficient loading and dispensing, and prevents access to the contained tablets 16 via peeling of the adjacent end flap of the carton 12.

The second major panel 26 includes a set of breakthrough chads 64 that align with the openings 58 of the first major panel 24. For instance, see FIG. 8. Each of the chads 64 may be defined by perforations that may be provided in an oval shape. The openings or cutouts 58 may be provided in a matching shape and size relative to that of the chads 64.

A third major panel 28 is interconnected laterally to a side 66 of the first major panel 24 via a minor panel 42 and a pair of fold lines or creases 68. The minor panel 42 forms a sidewall of the carton (for instance, see FIG. 6), and the third major panel 28 forms an interior layer of a double-walled front wall of the carton 12 when folded into position. The third major panel 28 includes a series of push tabs 70 that align with blister compartments 18 of the blister card 14. The push tabs 70 are defined by an arched shape perforated end 72 and straight perforated side edges 74 providing an overall "U"-shape to the push tabs 70. The end 75 of the U-shape that is opposite the arched-shaped perforated end 72 is a creased and non-perforated edge. See FIG. 1. Thus, during use, pressure applied to the top of the push tab 70 may be used to break the push tab 70, but does not completely tear the push tab 70 from the third major panel 28. Thus, the push tabs 70 have a structure of a so-called "hanging chad".

A fourth major panel 30 is interconnected laterally to an opposite side 76 of the first major panel 24 via a minor panel 44 and a pair of fold lines or creases 78. The minor panel 44 forms a sidewall of the carton and the fourth major panel 30 forms an exterior layer of the double-walled front of the carton 12 when folded into position. The double-layered front of the carton 12 increases puncture and tear resistance of the package 10. In addition, the layers are adhered together with an adhesive or the like to prevent separation or peeling of the layers.

Figure 9:
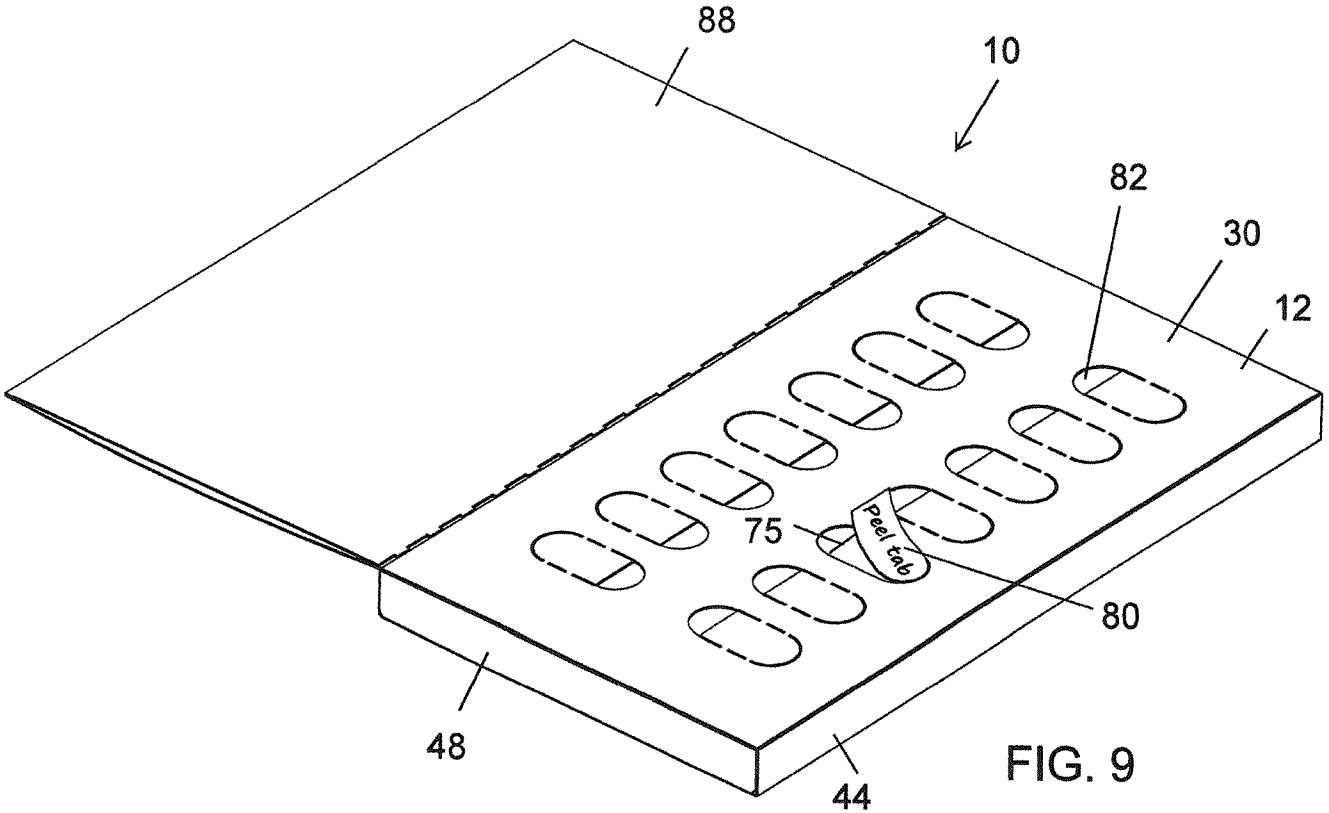
FIG. 9 is a perspective view of the fully assembled package of FIG. 7 showing a peel tab being removed from a front of the package according to the first embodiment.
Figure 10:
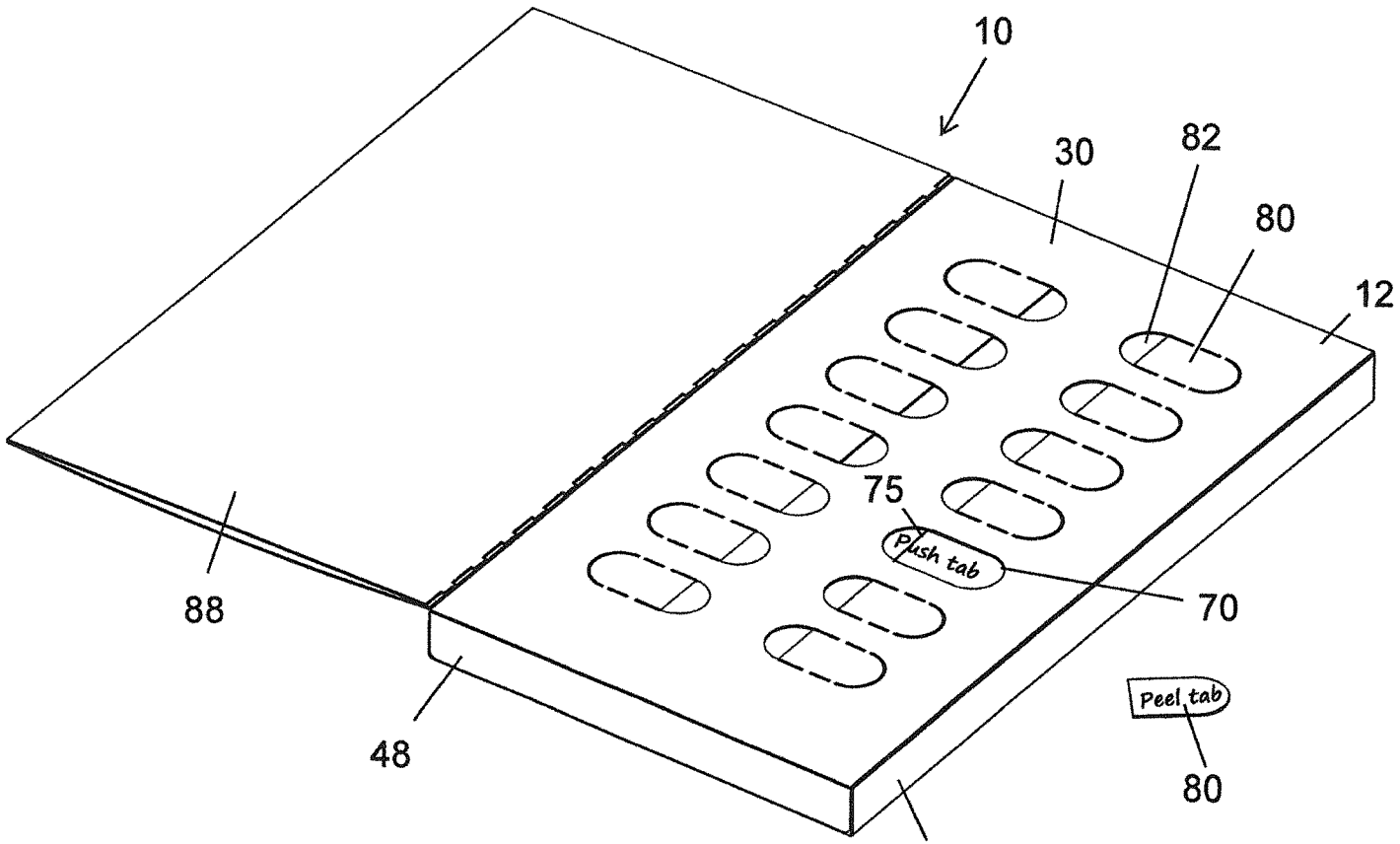
FIG. 10 is a perspective view of the fully assembled package of FIG. 9 with the peel tab removed and a push tab exposed according to the first embodiment.

The fourth major panel 30 includes a series of pull or peel tabs 80 that align with the push tabs 70 and blister compartments 18. Thus, as shown in FIGS. 9 and 10, for instance, a peel tab 80 may be peeled from the front wall of the carton 12 to expose the underlying push tab 70. Preferably, an opening 82 is located adjacent each peel tab 80 to permit initial gripping of a free, exposed edge of the peel tab 80.

Figure 6:
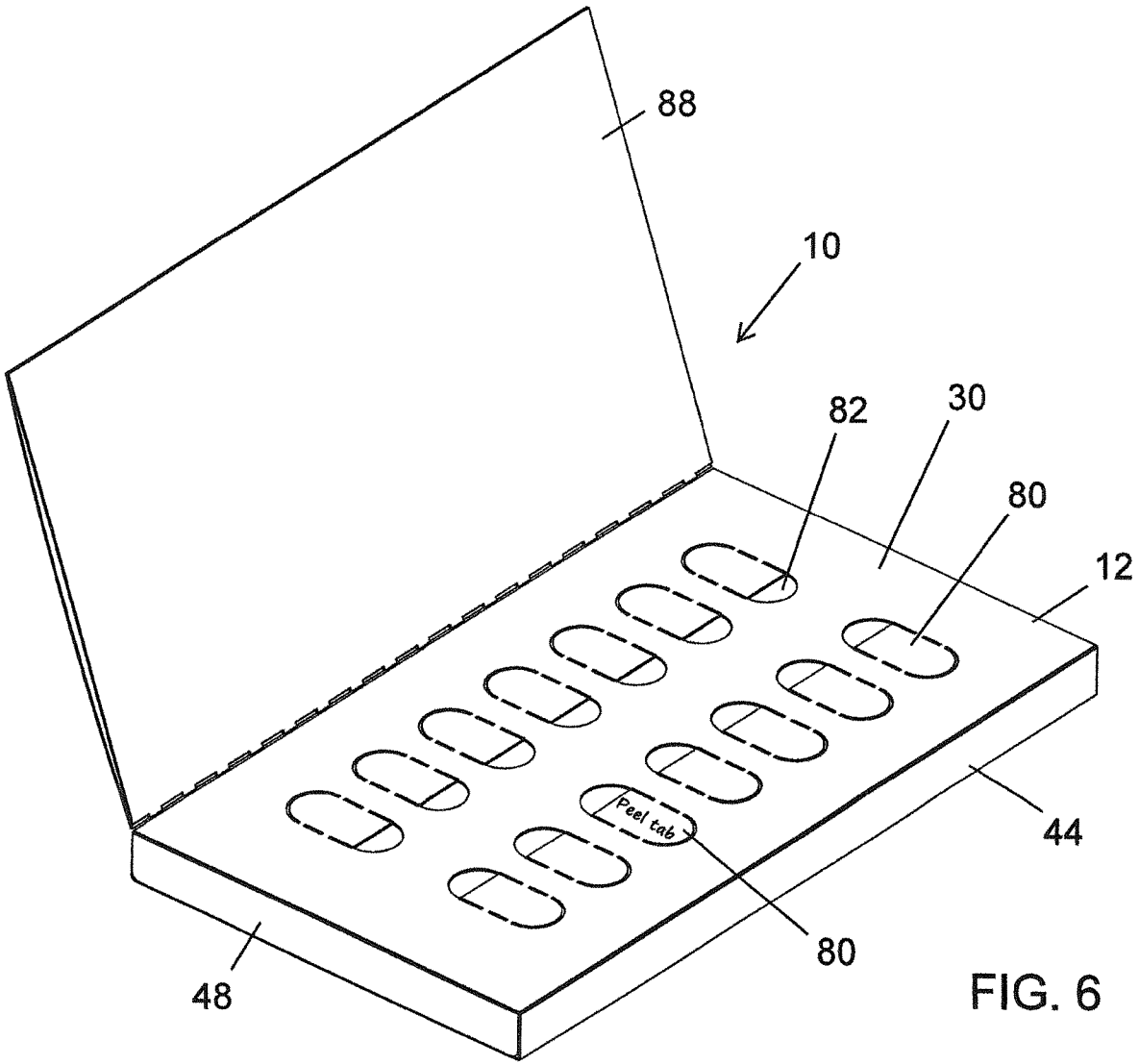
FIG. 6 is a perspective view of the fully assembled package of FIG. 5 with the cover flap pivoted to a partially open position according to the first embodiment.
Figure 7:
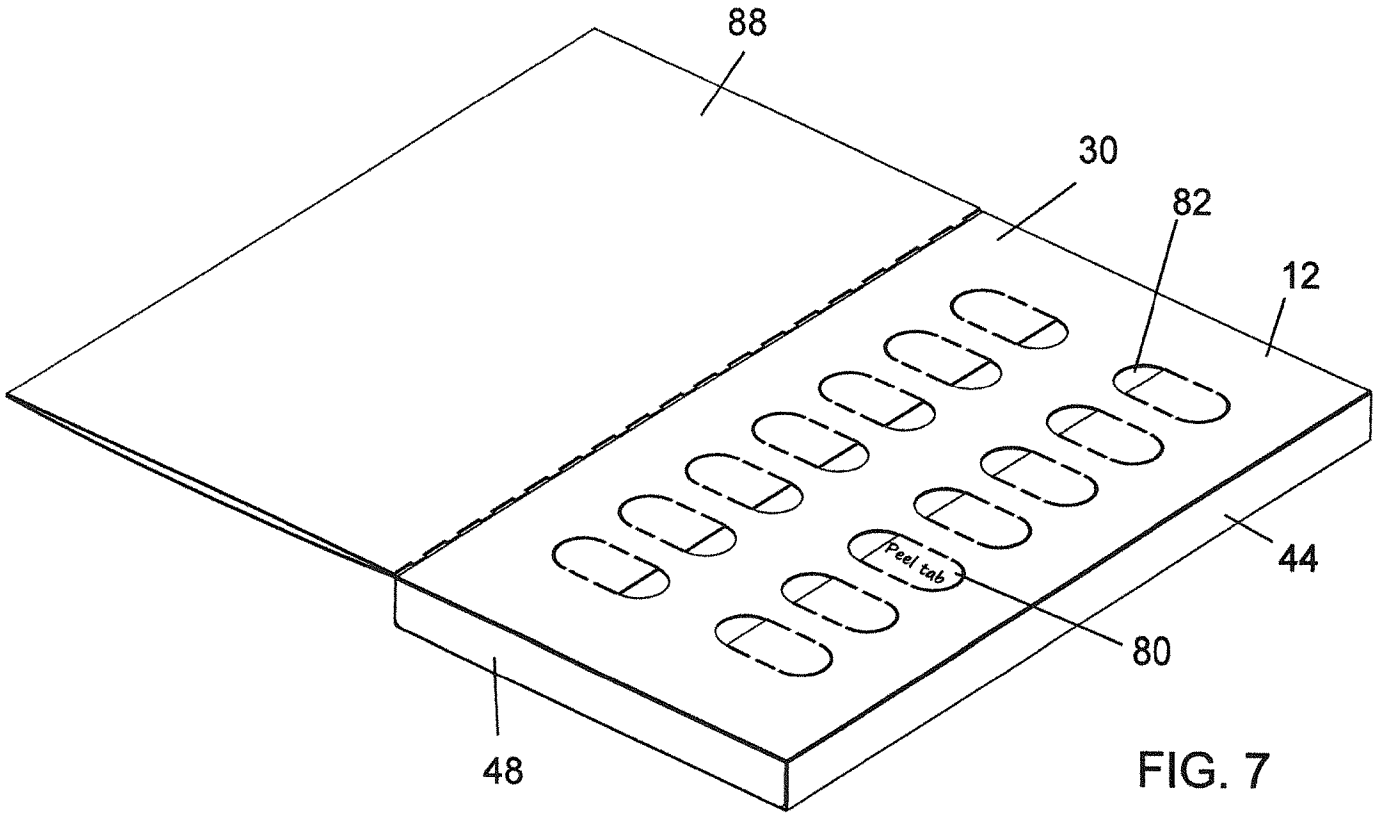
FIG. 7 is a perspective view of the fully assembled package of FIG. 5 with the cover flap pivoted to a fully open position according to the first embodiment.

A fifth major panel 32 is interconnected laterally to a side edge of the fourth major panel 30 via a fold line or crease 84, and a sixth major panel 34 is interconnected laterally to a side edge of the fifth major panel 32 via a fold line or crease 86. The fifth and sixth major panels 32 and 34 are ultimately folded together to form a cover flap 88 of the package 10. For instance, see FIGS. 5-7 showing the cover flap 88 in positions preventing dispensing from the package 10 and permitting dispensing from the package 10.

The minor panels 46, 48, 50, 52 and 54 form other parts of the carton 12. For example, minor panels 46, 48 and 50 are folded via creases to from end walls of the carton 12, the minor panel 52 is used to form a one-way blister card locking mechanism 90 (i.e., one-way flap), and the minor panel 54 forms a connection strip that can be folded between the fifth and sixth major panels, 32 and 34, to adhesively secure the panels together to form the cover flap 88. The one-way blister card locking mechanism 90 provides a one-way flap that permits a blister card 14 to be loaded into a fully assembly carton 12; however, when the blister card 14 is loaded within the carton 12, the one-way flap 90 prevents removal of the blister card 14 from the carton 12 and stabilizes the position of the blister card 14 within the carton 12.

Figure 3:
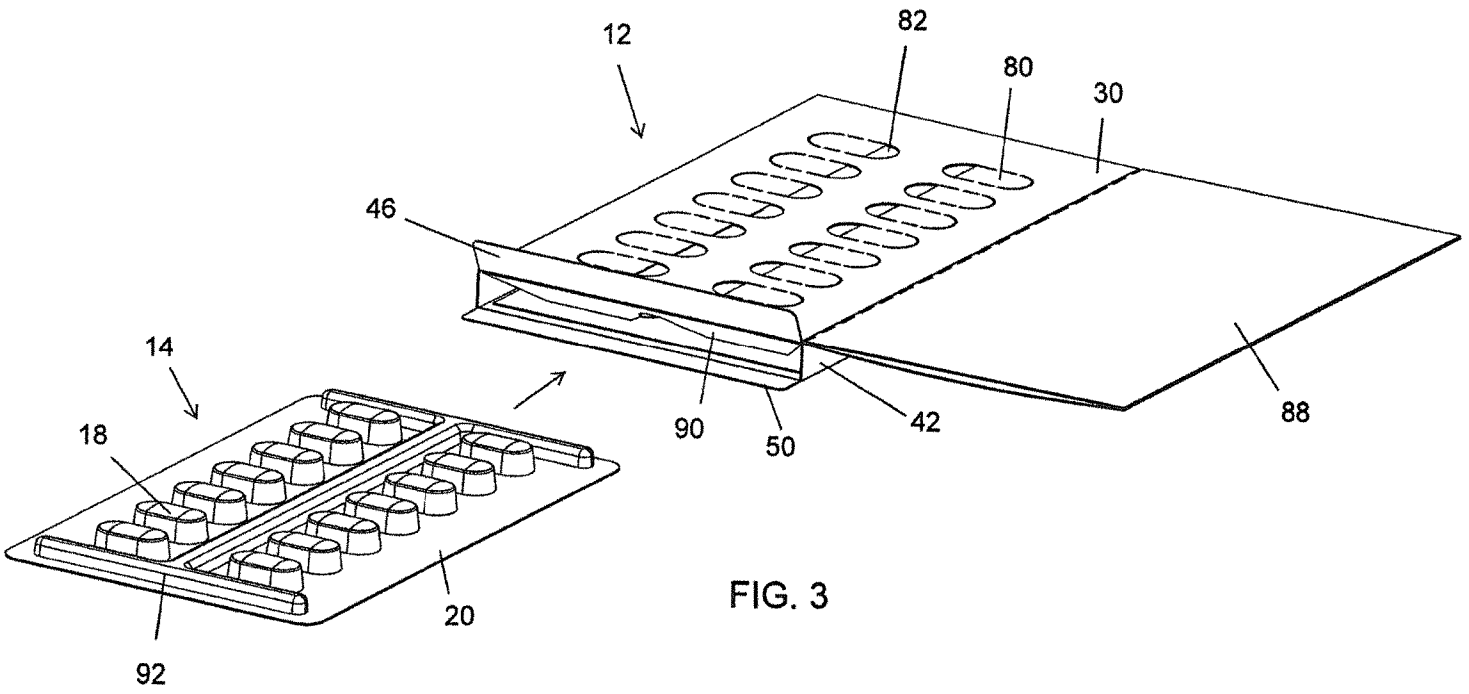
FIG. 3 is a perspective view of a carton formed by the blank of FIG. 1 with the blister card of FIG. 2 in position for insertion therein according to the first embodiment.

By way of example, FIG. 3 shows the carton 12 in a partially assembled condition in which the blank 22 is folded as discussed above and adhered together to form a double-walled front wall, a doubled-wall rear wall, an end wall with a false bottom, a pair of opposite sidewalls, and a cover flap. The various panels may be folded into this position and an adhesive or the like, such as various areas or strips of pressure sensitive adhesive may be provided on the blank and used to seal the various panels of the carton together. As shown in FIG. 3, a loading end of the carton 12 remains open and unsealed so that the blister card 14 may be inserted into the hollow carton 12.

Figure 4:
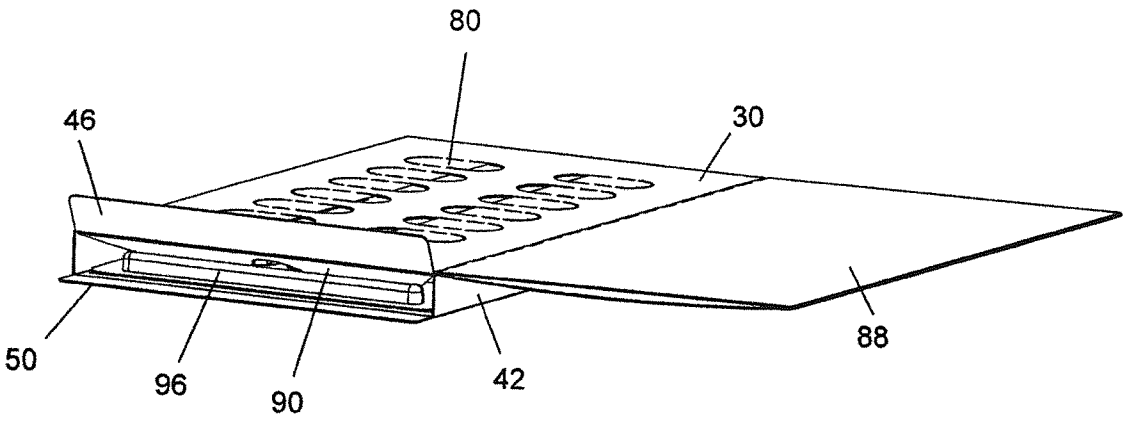
FIG. 4 is a perspective view of the blister card fully inserted into the carton of FIG. 3 according to the first embodiment.

As discussed above, the one-way blister locking mechanism 90 may be formed at the loading end of the carton 12. The one-way flap 90 is folded into the carton 12 and is connected to the carton solely by a fold line or crease initially formed in the blank 22. Thus, the one-way flap 90 is positioned to pivot up and down relative to the edge of the loading end of the carton 12. Accordingly, as a blister card 14 is inserted into the carton 12 via the open loading end, the upstanding blister compartments 18 on the blister card 14 deflect the one-way flap 90 upward to permit entrance of the blister card 14 into the carton 12. However, after the blister card 14 is fully inserted into the carton 12 as shown in FIG. 4, the one-way flap 90 prevents the blister card 14 from movement in an opposite direction. At this point in the assembly, the end panels forming the loading end are sealed closed with an adhesive or the like to complete the assembly of the package 10 and lock the blister card 14 within the carton 12.

FIG. 5 shows the package 10 fully assembled with the cover flap 88 folded over the front wall of the package 10 thereby hiding and protecting the peel tabs 80 formed on the front wall of the carton 12. If desired, the cover flap 88 may at least initially be sealed in the closed position with an adhesive, tear tab, wrapping material, or the like. Alternatively, the cover flap may include reusable tape, a hook and loop fastener, or other fastening mechanism to secure the cover flap 88 to the front wall of the carton 12 after initial use.

When a tablet 16 is to be dispensed, the cover flap 88 may be folded open as best shown in FIGS. 6 and 7. In this condition, the peel tabs 80 become accessible to the user. As shown in FIGS. 9 and 10, a peel tab 80 may be peeled from the exterior panel forming the double-walled front wall of the carton 12 thereby exposing a push tab 70 formed on the interior panel of the double-walled front wall of the carton 12.

Figure 8:
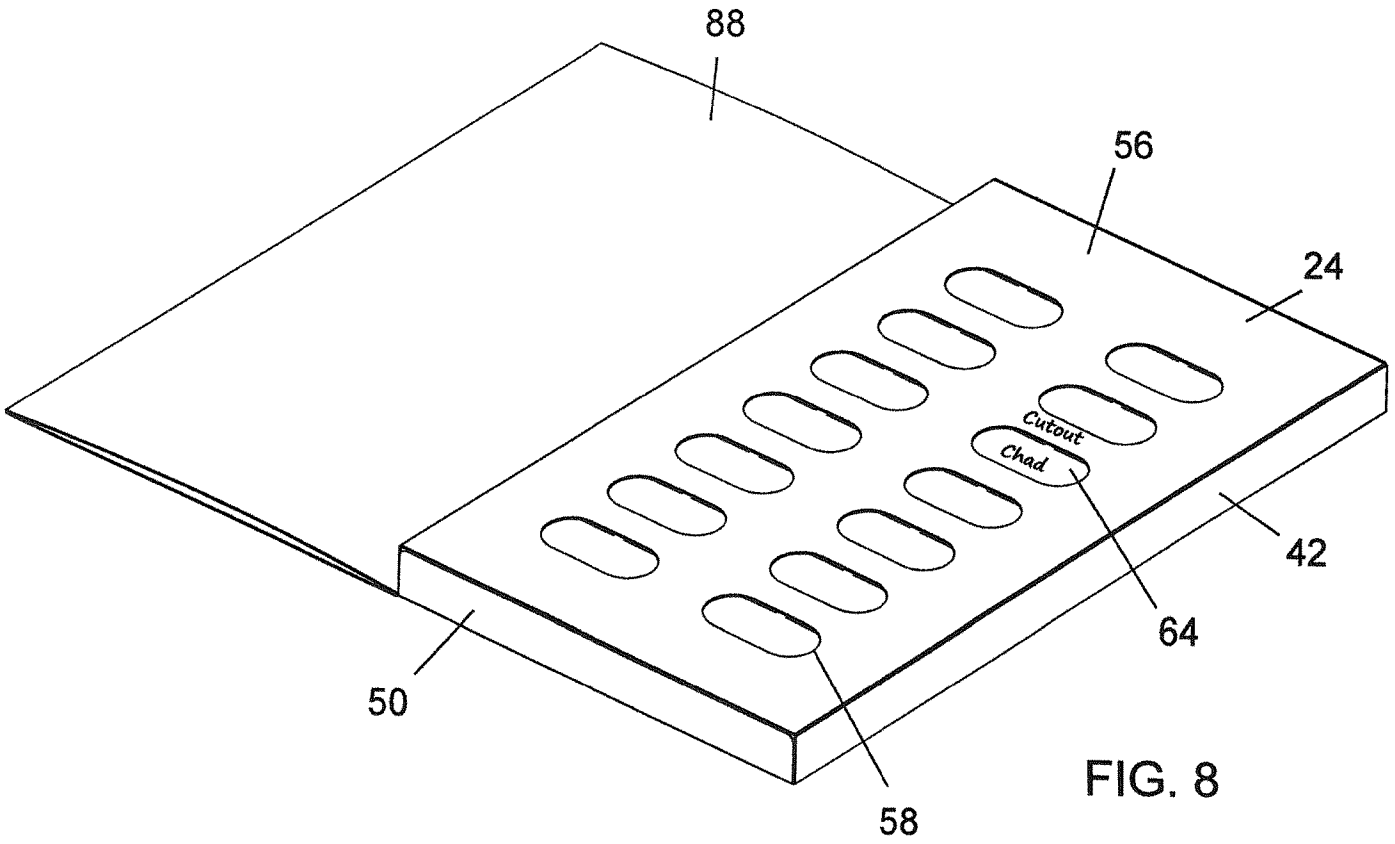
FIG. 8 is a perspective view of the rear of the package of FIG. 7 according to the first embodiment.

FIG. 8 shows the rear wall of the carton 12. The exterior panel of the double-walled rear wall of the carton 12 has the series of openings 58 aligned with chads 64 formed on the interior wall of the double-walled rear wall. Each opening 58 and chad 64 combination is aligned directly behind one of the blister compartments 18 of the blister card 14 and with one of the peel or pull tabs 80 and push tab 70 combination on the front wall of the carton.

Figure 11:
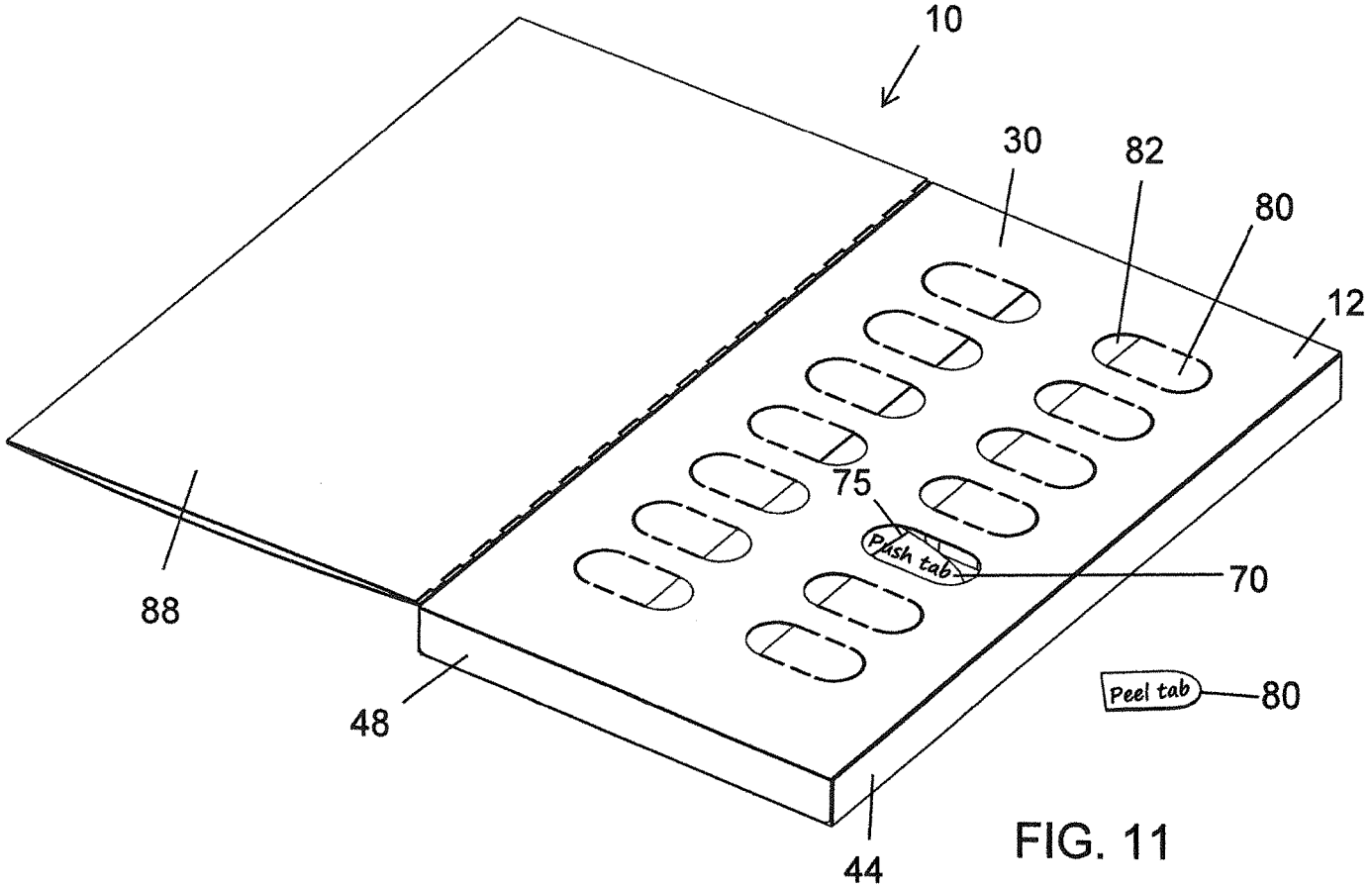
FIG. 11 is a perspective view of the fully assembled package of FIG. 10 with the push tab pressed inward according to the first embodiment.
Figure 12:
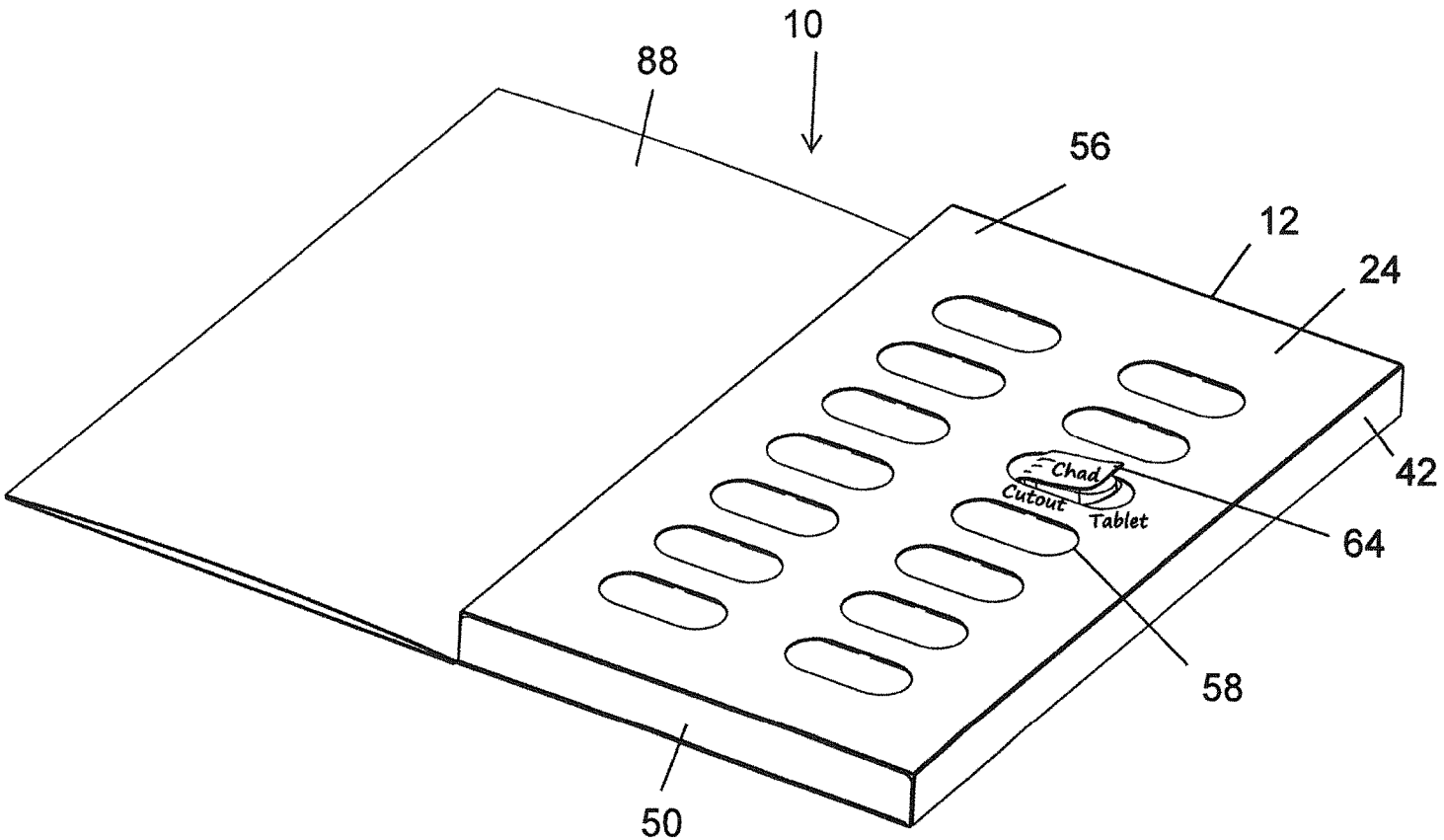
FIG. 12 is a perspective view of the rear of the fully assembled package of FIG. 11 with a chad and tablet protruding through a cutout opening of the package according to the first embodiment.

Accordingly, as shown in FIGS. 11 and 12, when the user presses downward on the push tab 70 with sufficient force to break the push tab 70 and applies pressure on a top of a blister compartment 18 located therebelow to force the tablet 16 to break through the backing foil of the blister card 14 and the chad 64 located therebehind, the tablet 16 may be dispensed through the corresponding opening 58 in the rear wall of the carton 12.

Figure 13:
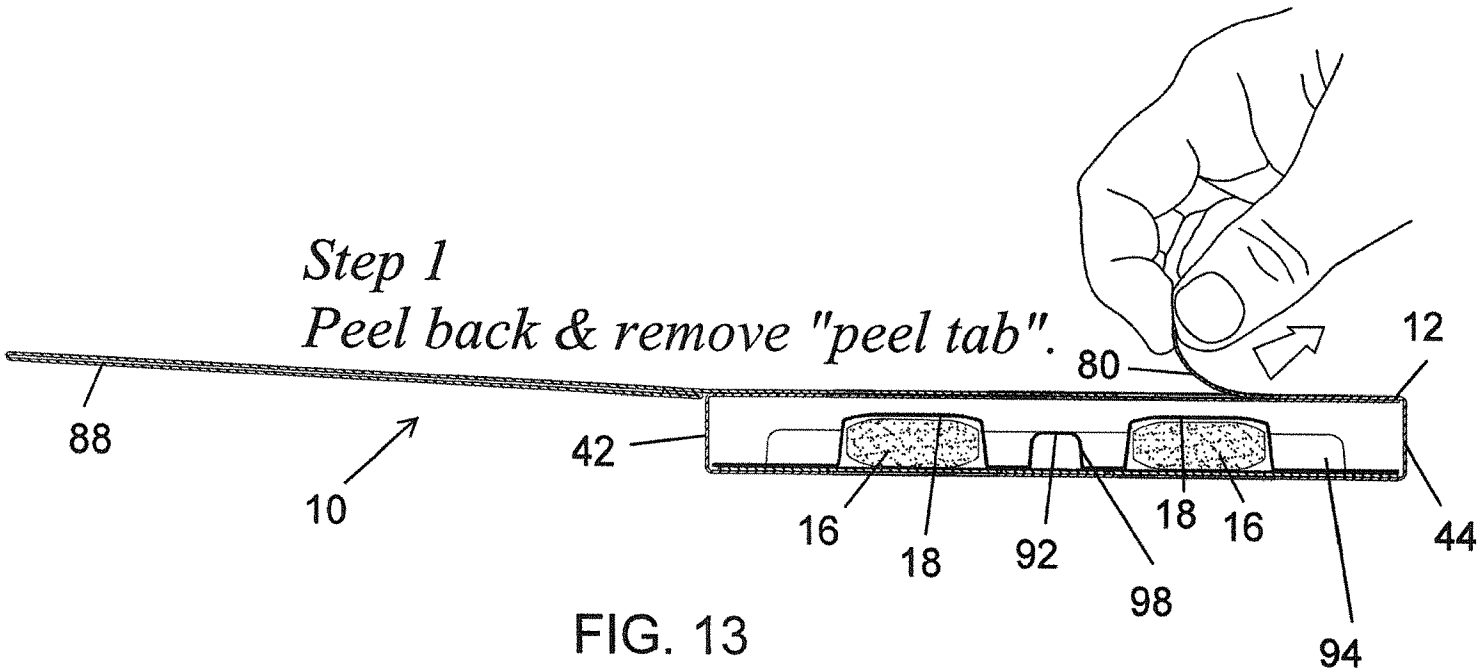
FIG. 13 is a cross-sectional view of a blister-in-carton package showing a step of removing a peel tab according to the first embodiment.
Figure 14:
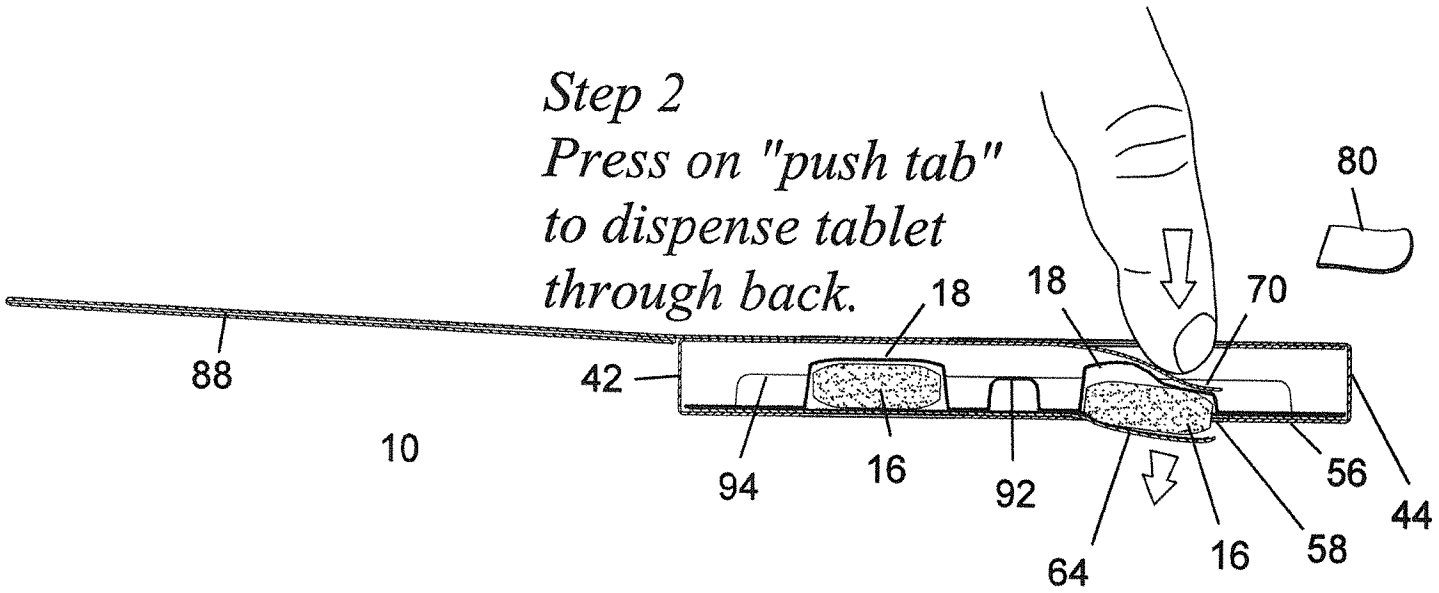
FIG. 14 is a cross-sectional view of the blister-in-carton package of FIG. 13 showing a step of pressing a push tab to dispense a tablet through the rear of the package according to the first embodiment.

The above referenced dispensing process is shown in FIGS. 13 and 14. In FIG. 13, the cover flap 88 is pivoted to an open position permitting access to the front wall of the carton 12. The user peels back and completely removes one of the peel tabs 80 from the front wall by gripping a free end of the peel tab 80 with their finger and thumb. Thereafter, as shown in FIG. 14, the user presses downwardly with the tip of their finger to cause the push tab 70 to deflect downward in contact with a top of an aligned blister compartment 18. Continued pressure causes the blister compartment 18 to collapse into the tablet 16 and the tablet 16 to break through the chad 64 and any backing foil located on the blister card 14. Accordingly, the tablet 16 is able to be dispensed through the corresponding opening 58 on the rear wall of the carton 12. At this point the cover flap 88 may be re-closed and the package stored for later use in dispensing the next dose, when needed.

According to one embodiment of a blister card 14, the blister card 14 may include a raised molded ridge 92 as shown in FIG. 2. The ridge 92 is located to provide strength to the blister card 14 and carton 12 and to reduce crushing of the carton 12 while a user is peeling and pushing various parts of the package 10 to dispense a tablet 16. The added strength and rigidity added by the ridge 92 to the package 10 enables the package 10 to achieve higher levels of child resistance and maintain the higher level throughout a dosing regimen contained by the package.

As shown in FIG. 2, the ridge 92 may be provided as an upstanding hollow "I" shaped rib that includes a pair of opposed, laterally-extending, elongate end portions, 94 and 96, providing structural support transversely at the ends of the package 10 and an elongate spine portion 98 providing structural support along the length of the package 10 between the opposite ends thereof and between rows of blister compartments 18. In the illustrated embodiment, the spine 98 is continuous and extends centrally of the blister card between two rows of blister compartments 18.

The carton 12 may be made from a blank 22 of paperboard or like sheet material. For example, the sheet material can be a SBS (solid bleached sulfate) paperboard stock material of a desired thickness. This type of material can be provided in a relatively flat blank form on which panels, fold lines, cutouts, openings, perforations, or the like can be readily formed, die cut, and/or defined. The material of the blank 22 may be capable of being coated with a continuous or discontinuous layer of a heat and/or pressure activated adhesive at desired locations for purposes of forming the sleeve or carton shape. Further, certain sides of the blank may be provided as being glossy or otherwise of a desired texture and/or appearance for forming the visible external surfaces of the package 10.

Although the use of paperboard is discussed above, it should be understood that other materials can also be utilized, such as, molded materials, composite materials, multilayered materials, plastic materials, metal foils, paper, or the like. The materials used to form the package 10 may be recyclable materials such that after all tablets have been dispensed from the package, the package 10 can be recycled in its entirety.

Various modifications to the package and its method of assembly can be used. For instance, the number, shape and configuration of the various panels and flaps of the blank 22 forming the carton 12 can be altered. The shape, size and/or pattern of the perforations, cutouts, tabs, chads, and the like can be changed. Different types of adhesives and other means to bond the panels of the carded package together can be used. Different materials within a range of different thicknesses can be used. The shape, location and configuration of the blister compartments, chads, tabs, and support rib of the blister card can be altered.

Second Embodiment of a Blister-in-Carton Package

The details of a second embodiment of a blister-in-carton package is shown in FIGS. 15-20. Similar to the first embodiment, the second embodiment provides a fully assembled package 110, such as shown in FIGS. 17-20, and may be of a relatively-compact, thin, elongate, and/or of rectangular configuration. Of course, the package may be formed in other shapes and configurations.

Figures 15, 16:
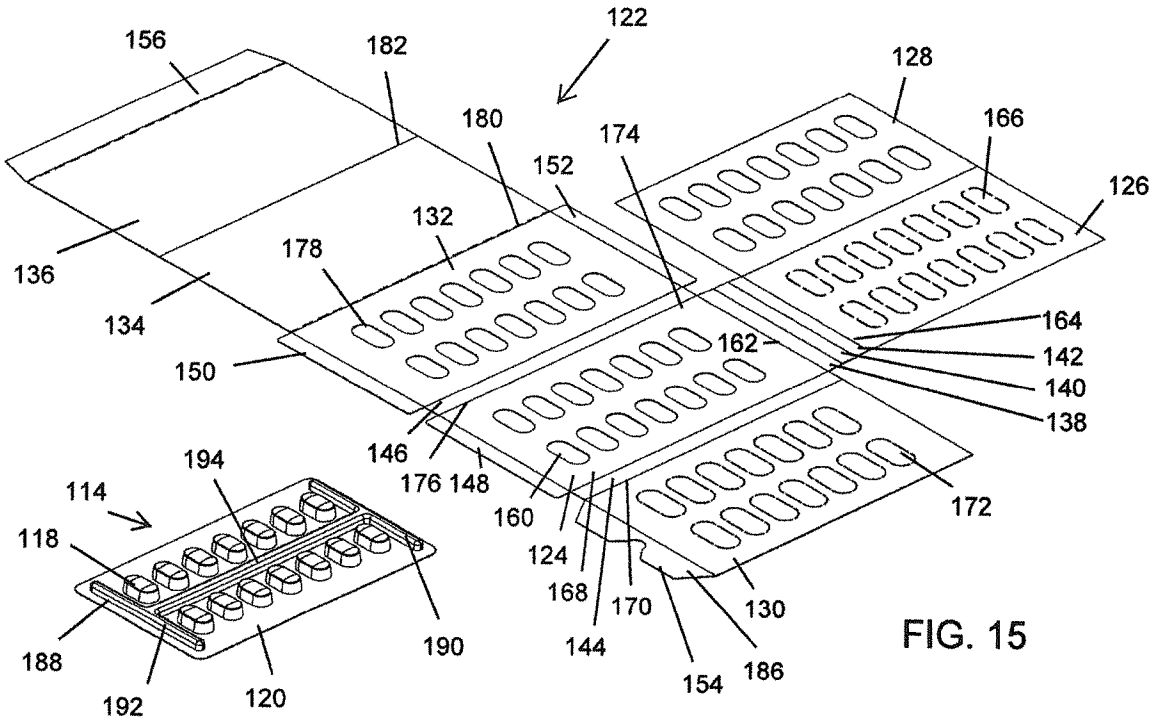
FIG. 15 is a perspective view of an unfolded carton blank used to form a carton according to a second embodiment.
FIG. 16 is a perspective view of a blister card according to the second embodiment.

The package 110 includes a hollow carton 112 forming a protective case that is shaped to receive and house a separately-manufactured blister card 114 such as shown in FIG. 16. Typically, the package 110 is provided of a size that can be readily held in the hand of an intended end user and that contains a predetermined number of doses or tablets. By way of example, the blister card 114 may designed to contain fourteen separate tablets 116 in fourteen separate blister compartments 118. Of course, the number, shape, pattern, and size of blister compartments 118 and tablets 116 may be altered from that illustrated depending on the pharmaceutical drug being packaged.

The package 110 is structured such that tablets 116 can be readily dispensed from the package 110 via a sequence of manipulations by the fingers of an intended end user, such as a senior citizen. However, the structure of the package 110 and sequence of steps required to dispense a tablet 116 is such that the package 110 provides a desired level of child-resistance whereby unintended persons, such as young children, cannot perform the sequence of manipulations and dispense a tablet 116 from the package 110. The level of child resistance must be maintained not only relative to a new package containing a complete set of tablets, but also for a partially used package from which one or more tablets 116 may have already been dispensed.

The blister card 114 may be provided in various forms. In the illustrated embodiment, the blister card 114 is made from a generally planar card 120 molded in a manner forming a plurality of integral, separate, spaced-apart, upstanding blister compartments 118 providing a plurality of separate hollow compartments in which a tablet, pill or other small article 116 may be loaded. A backing may be applied to the rear of the card 120 to seal tablets 116 loaded on the blister card 114 in the upstanding blister compartments 118. The backing may be provided by a single layer of metal foil or the like.

The plurality of separate blister compartments 118 permit a tablet 116 to be dispensed from one compartment without disturbing the other blister compartments of the blister card 114 and the remaining tablets 116 stored on the blister card. The card 120 and blister compartments 118 may be formed or molded of a thermoplastic material that may be transparent. Of course, other materials and blister card configurations and structures may be used.

A foldable sheet of material or carton blank 122 for use in forming the hollow carton 112 is shown in FIG. 15. The blank 122 may be made of a sheet of cardboard, paperboard, plastic, or the like. The blank 22 may be formed from a single integral sheet of material having been cut, perforated, creased, etc., for instance, as shown in FIG. 15.

The blank 122 may include seven relatively large major panels 124, 126, 128, 130, 132, 134 and 136 and ten relatively-smaller minor panels 138, 140, 142, 144, 146, 148, 150, 152, 154 and 156. By way of example, a first major panel 124 may form a rear wall 158 of the fully assembled package 110 and may include a plurality of openings or cutouts 160. In the assembled package 110, each opening or cutout 160 is aligned directly behind one of the blister compartments 118 of the blister card 114 contained within the carton 112.

A second major panel 126 extends from an end 162 of the first major panel 124 with three minor panels 138, 140 and 142, and four fold lines or pre-formed creases 164 therebetween. The three minor panels, 138, 140 and 142, are folded to produce a so-called hollow false bottom within the carton 112 and to locate the second major panel 126 directly on top of the first major panel 124. In addition, a third major panel 128 extends laterally from the second major panel 126 and folds thereon thereby forming a triple-walled rear wall of the carton 112. The triple-layered rear of the carton 112 increases puncture and tear resistance of the package 110. In addition, the layers are adhered together with an adhesive or the like to prevent separation or peeling of the layers. The false bottom provides support for the carton 112 from crushing, aides in keeping the blister card 114 properly aligned for efficient loading and dispensing, and prevents access to the contained tablets 116 via peeling of the adjacent end flap of the carton 112.

The second major panel 126 includes a set of break-through chads 166 that align with the openings 160 of the first major panel 124. For instance, see FIG. 18. Each of the chads 166 may be defined by perforations that may be provided in an oval shape. The openings or cutouts 160 may be provided in a matching shape and size relative to that of the chads 166.

A fourth major panel 130 is interconnected laterally to a side 168 of the first major panel 124 via a minor panel 144 and a pair of fold lines or creases 170. The minor panel 144 thin's a sidewall of the carton (for instance, see FIG. 17). The fourth major panel 130 forms an interior layer of a double-walled front wall of the carton 112 when folded into position. The fourth major panel 130 includes a series of break-through chads 172 that align with blister compartments 118 of the blister card 114. The break-through chads 172 are defined by perforations that may be provided in an oval shape. Chads 172 may be larger, smaller, or the same size as chads 166.

A fifth major panel 132 is interconnected laterally to an opposite side 174 of the first major panel 124 via a minor panel 146 and a pair of fold lines or creases 176. The minor panel 146 forms a sidewall of the carton and the fifth major panel 132 forms an exterior layer of the double-walled front of the carton 112 when folded into position. The double-layered front of the carton 112 increases puncture and tear resistance of the package 110. In addition, the layers are adhered together with an adhesive or the like to prevent separation or peeling of the layers.

Figure 17:
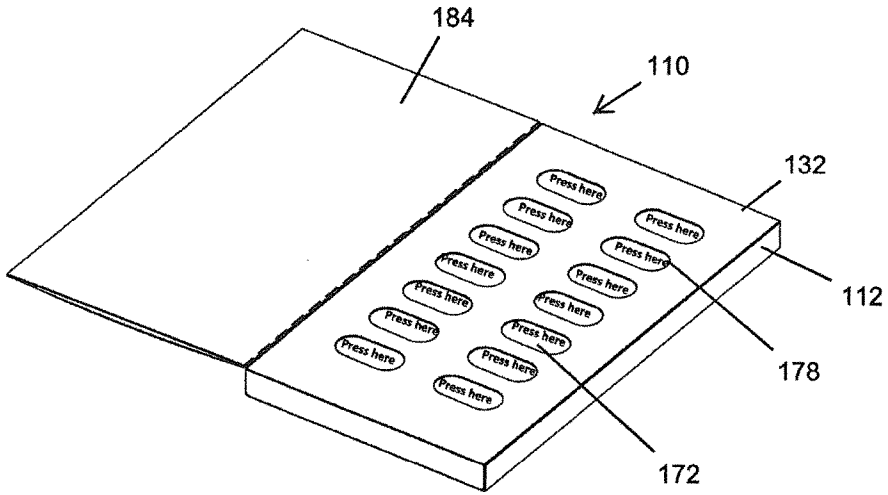
FIG. 17 is perspective view of a fully assembled package formed by the carton blank of FIG. 15 with the blister card of FIG. 16 contained therein and with a cover flap pivoted to a fully open position according to the second embodiment.
Figure 19:
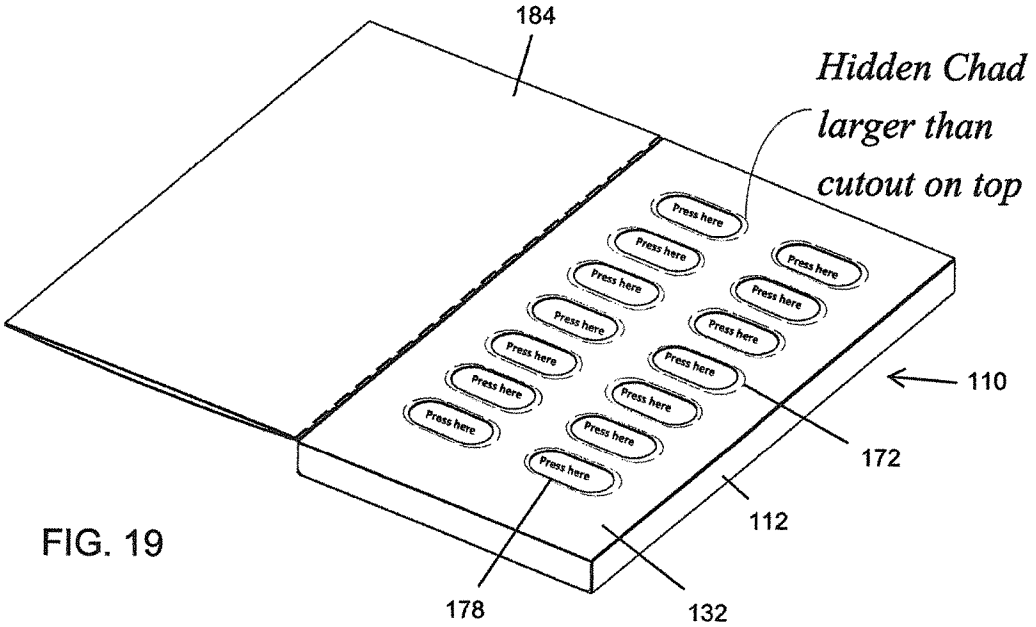
FIG. 19 is perspective view of the fully assembled package of FIG. 17 showing the hidden chads in phantom according to the second embodiment.

The fifth major panel 132 includes a series of openings 178 that align with the chads 172 and blister compartments 118. As shown in FIGS. 17 and 19, for instance, the openings 178 are smaller than the chads 172; thus, the chads 172 are only partially visible and the perforations forming the chads are not visible. Accordingly, the presence of the chads 172 are hidden from a user, such as a child. The visible part of the chad may include indicia, such as "Press Here".

A sixth major panel 134 is interconnected laterally to a side edge of the fifth major panel 132 via a fold line or crease 180, and a seventh major panel 136 is interconnected laterally to a side edge of the sixth major panel 134 via a fold line or crease 182. The sixth and seventh major panels 134 and 136 are ultimately folded together to form a cover flap 184 of the package 110. For instance, see FIGS. 17-20 showing the cover flap 184 in a position permitting dispensing from the package 110. Of course, the cover flap 184 may also be pivoted to prevent dispensing.

The minor panels 148, 150, 152, 154 and 156 foil other parts of the carton 112. For example, minor panels 148, 150 and 152 are folded via creases to from end walls of the carton 112, the minor panel 154 is used to form a one-way blister card locking mechanism 186 (i.e., one-way flap), and the minor panel 156 forms a connection strip that can be folded between the sixth and seventh major panels, 134 and 136, to adhesively secure the panels together to form the cover flap 184. The one-way blister card locking mechanism 186 provides a one-way flap that permits a blister card 114 to be loaded into a fully assembly carton 112; however, when the blister card 114 is loaded within the carton 112, the one-way flap 186 prevents removal of the blister card 114 from the carton 112 and stabilizes the position of the blister card 114 within the carton 112.

By way of example, FIGS. 17-20 show the carton 112 in an assembled condition in which the blank 122 is folded as discussed above and adhered together to form a double-walled front wall, a triple-walled rear wall, an end wall with a false bottom, a pair of opposite sidewalls, and a cover flap. The various panels may be folded into this position and an adhesive or the like, such as various areas or strips of pressure sensitive adhesive may be provided on the blank and used to seal the various panels of the carton together. The blister card 114 may be inserted into the hollow carton 112 and contained therein.

As discussed above, the one-way blister locking mechanism 186 may be formed at the loading end of the carton 112. The one-way flap 186 is folded into the carton 112 and is connected to the carton solely by a fold line or crease initially formed in the blank 122. Thus, the one-way flap 186 is positioned to pivot up and down relative to the edge of the loading end of the carton 112. Accordingly, as a blister card 114 is inserted into the carton 112 via an open loading end, the upstanding blister compartments 118 on the blister card 114 deflect the one-way flap 186 upward to permit entrance of the blister card 114 into the carton 112. However, after the blister card 114 is fully inserted into the carton 112, the one-way flap 188 prevents the blister card 114 from movement in an opposite direction. At this point in the assembly, the end panels forming the loading end are sealed closed with an adhesive or the like to complete the assembly of the package 110 and lock the blister card 114 within the carton 112.

The cover flap 184 may be folded over the front wall of the package 110 thereby completely hiding and protecting the chads 172 via the front wall of the carton 112. If desired, the cover flap 184 may at least initially be sealed in the closed position with an adhesive, tear tab, wrapping material, or the like. Alternatively, the cover flap 184 may include reusable tape, a hook and loop fastener, or other fastening mechanism to secure the cover flap 184 to the front wall of the carton 112 after initial use.

Figure 18:
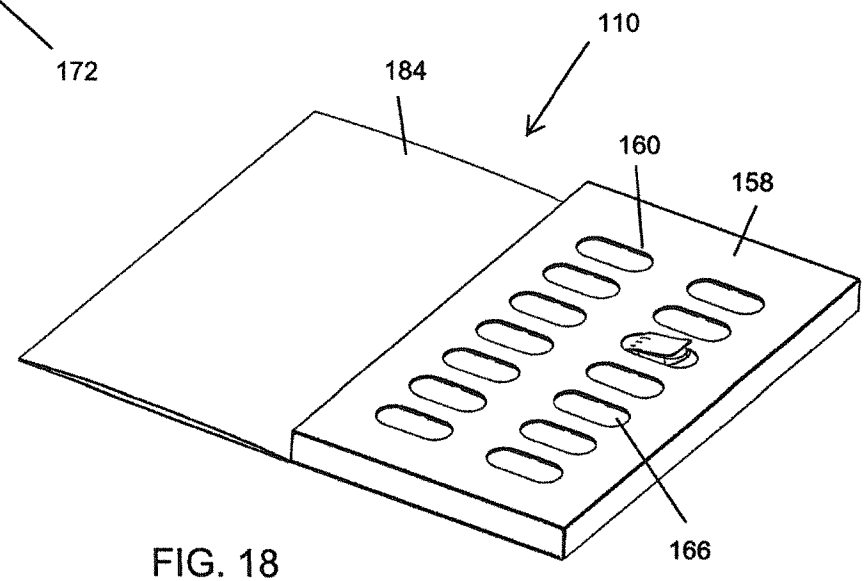
FIG. 18 is perspective view of the rear of the package of FIG. 17 according to the second embodiment.
Figure 20:
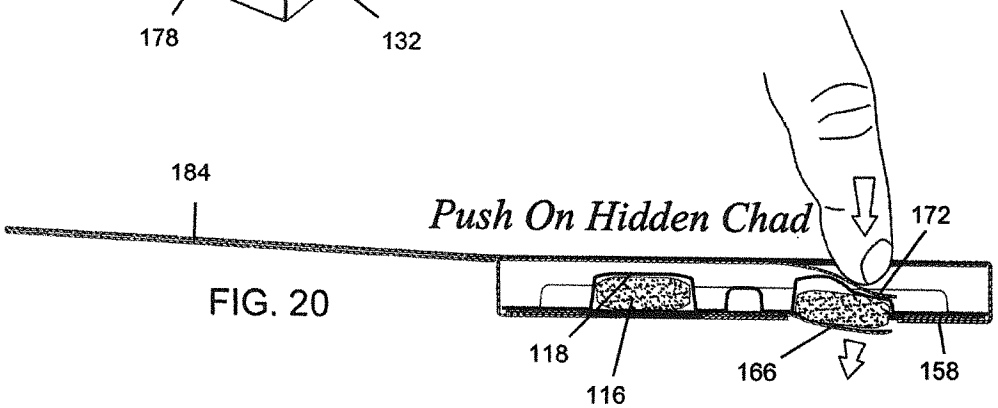
FIG. 20 is a cross-sectional view of a blister-in-carton package showing a step of pressing the hidden chad to dispense a tablet through the rear of the package according to the second embodiment.

When a tablet 116 is to be dispensed, the cover flap 184 may be folded open as shown in FIGS. 17-20. In this condition, the chads 172 (although partially hidden from view of the end user) become accessible to the user. As shown in FIG. 20, an end user may use a finger to push down on one of the chads 172 of the carton 112. As shown in FIGS. 18 and 20, this action causes the chad 166 to tear along its perforations to permit a tablet 116 to break through the rear of the carton 112. Accordingly, when the user presses downward on the chad 172 with sufficient force to break the chad 172 and applies pressure on a top of a blister compartment 118 located therebelow to force the tablet 116 to break through the backing foil of the blister card 114 and the chad 166 located therebehind, the tablet 116 may be dispensed through the corresponding opening 160 in the rear wall of the carton 112. At this point, the cover flap 184 may be re-closed and the package stored for later use in dispensing the next dose, when needed.

As discussed previously, the blister card 114 may include a raised molded ridge 188 as shown in FIG. 16. The ridge 188 is located to provide strength to the blister card 114 and carton 112 and to reduce crushing of the carton 112 while a user is peeling and pushing various parts of the package 110 to dispense a tablet 116. The added strength and rigidity added by the ridge 188 to the package 110 enables the package 110 to achieve higher levels of child resistance and maintain the higher level throughout a dosing regimen contained by the package.

As shown in FIG. 16, the ridge 188 may be provided as an upstanding hollow "I" shaped rib that includes a pair of opposed, laterally-extending, elongate end portions, 190 and 192, providing structural support transversely at the ends of the package 110 and an elongate spine portion 194 providing structural support along the length of the package 110 between the opposite ends thereof and between rows of blister compartments 118. In the illustrated embodiment, the spine 194 is continuous and extends centrally of the blister card between two rows of blister compartments 118.

The carton 112 may be made from a blank 122 of paperboard or like sheet material. For example, the sheet material can be a SBS (solid bleached sulfate) paperboard stock material of a desired thickness. This type of material can be provided in a relatively flat blank form on which panels, fold lines, cutouts, openings, perforations, or the like can be readily formed, die cut, and/or defined. The material of the blank 122 may be capable of being coated with a continuous or discontinuous layer of a heat and/or pressure activated adhesive at desired locations for purposes of forming the sleeve or carton shape. Further, certain sides of the blank may be provided as being glossy or otherwise of a desired texture and/or appearance for forming the visible external surfaces of the package 110.

Although the use of paperboard is discussed above, it should be understood that other materials can also be utilized, such as, molded materials, composite materials, multilayered materials, plastic materials, metal foils, paper, or the like. The materials used to form the package 110 may be recyclable materials such that after all tablets have been dispensed from the package, the package 110 can be recycled in its entirety.

Various modifications to the package and its method of assembly can be used. For instance, the number, shape and configuration of the various panels and flaps of the blank 122 forming the carton 112 can be altered. The shape, size and/or pattern of the perforations, cutouts, tabs, chads, and the like can be changed. Different types of adhesives and other means to bond the panels of the carded package together can be used. Different materials within a range of different thicknesses can be used. The shape, location and configuration of the blister compartments, chads, tabs, and support rib of the blister card can be altered.

Third Embodiment of a Blister-in-Carton Package

Figure 21:
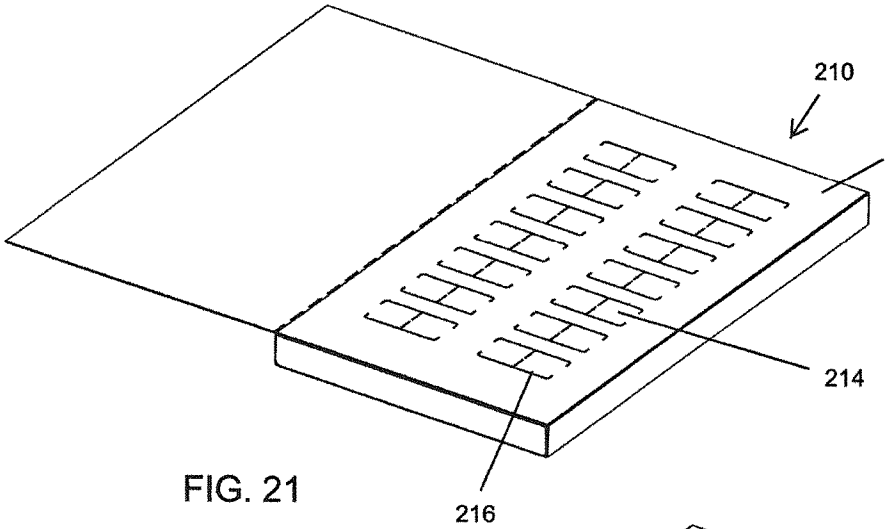
FIG. 21 is perspective view of a blister-in-carton package with a cover flap pivoted to a fully open position according to a third embodiment.
Figure 22:
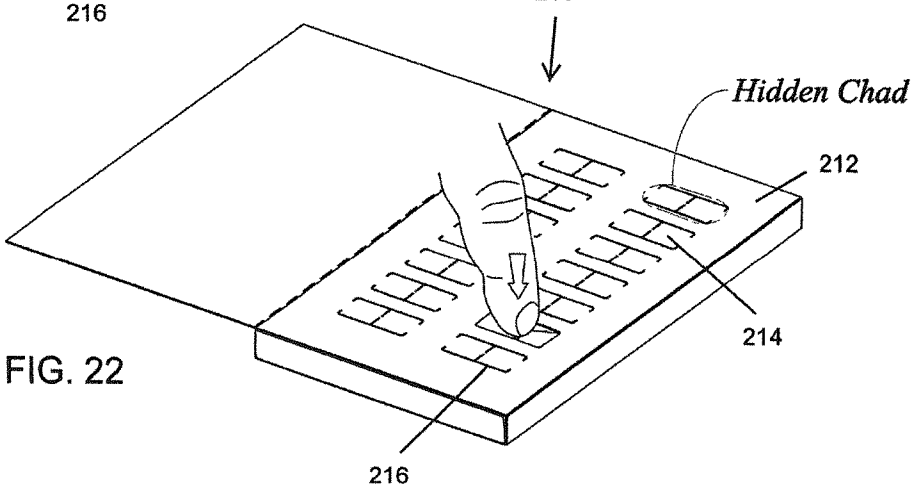
FIG. 22 is perspective view of the blister-in-carton package of FIG. 21 showing a step of pressing a hidden chad to dispense a tablet through the rear of the package according to the third embodiment.

The details of a third embodiment of a blister-in-carton package is shown in FIGS. 21 and 22. Similar to the first embodiment, the second embodiment provides a fully assembled package 210 that may be of a relatively-compact, thin, elongate, and/or of rectangular configuration. Of course, the package may be formed in other shapes and configurations.

The package 210 is similar to the package 110 discussed above, except for the configuration of the front panel. The front panel 212 includes a series of gates 214 formed by H-shaped perforations 216. Chads are hidden beneath the gates 214. Thus, as shown in FIG. 22, finger pressure can be exerted downward on one the gates 214 to break open the H-shaped perforation, break-through an underlying chad, and then apply pressure to a blister compartment to break a tablet through the backing of the blister card and chad therebelow to dispense the tablet via an opening in a rear wall of the package.

Since the gate 214 hides the underlying chad, the package provides enhanced child resistance.

While packages, carton blanks, and methods of manufacture and use have been described in detail, various modifications, alterations, and changes may be made without departing from the spirit and scope of the packages, carton blanks, and methods according to the present invention as defined in the appended claims.

The invention claimed is:

1. A child-resistant package, comprising:

a hollow carton having opposed, spaced-apart, front and rear walls; and a separate blister card contained within said hollow carton, said blister card having a plurality of separate, spaced-apart hollow blister compartments;

said front wall of said hollow carton comprising a structure including an exterior wall panel having a plurality of separate openings and an interior wall panel adhesively secured to said exterior wall panel, said interior wall panel of said front wall having a plurality of break-through chads defined by perforations aligned directly between said plurality of openings and said plurality of blister compartments, said chads being larger than said openings such that said perforations are not visible in said front wall; and and said rear wall of said hollow carton comprising a structure including an exterior wall panel having a plurality of separate, openings and an interior wall panel adhesively secured to said exterior wall panel of said rear wall, said interior wall panel of said rear wall having a plurality of break-through chads directly aligned between said plurality of blister compartments and said plurality of openings.

2. The package according to claim 1, wherein each of said break-through chads on said interior wall panel of said rear wall is defined by perforations forming an oval and each of said openings on said exterior wall panel of said rear wall being of a shape matching and aligned with said perforations of said break-through chads.

3. The package according to claim 1, wherein said carton further comprises an end flap that extends from an edge of a loading end of said hollow carton and that pivots relative to said edge such that said one-way flap permits loading of said blister card into said hollow carton, prevents movement of said blister card within said hollow carton, and stabilizes a position of said blister card within said hollow carton.

4. The package according to claim 3, wherein said carton includes a false bottom on an end of said carton opposite said one-way flap such that said blister card is captured and positioned between said false bottom and said one-way flap of said carton in a position aligning said blister compartments of said blister card directly between said openings and chads of said front wall and said chads and openings of said rear wall of said carton.

5. The package according to claim 1, further comprising a separate tablet of medication housed within each of said blister compartments on said blister card.

6. The package according to claim 1, further comprising a cover flap connected to and pivoting relative to said carton such that said cover flap may be pivoted in a position covering said front wall of said carton and to a position exposing said front wall of said carton.

7. The package according to claim 1, wherein said blister card includes a raised ridge including a spine portion and opposite end portions projecting upwardly from said blister card.

8. The package according to claim 7, wherein said spine portion extends centrally along a length of said blister card between a pair of rows of blister compartments and said opposite end portions extend along opposite ends of said blister card with said plurality of blister compartments extending therebetween.

9. The package according to claim 8, wherein said ridge is I-shaped in plan.

10. A child-resistant package, comprising:

a hollow carton having opposed, spaced-apart, front and rear walls; and a separate blister card contained within said hollow carton, said blister card having a plurality of separate, spaced-apart hollow blister compartments;

said front wall of said hollow carton comprising a structure including an exterior wall panel having a plurality of gates formed by H-shaped perforations and an interior wall panel adhesively secured to said exterior wall panel, said interior wall panel of said front wall having a plurality of break-through chads defined by perforations aligned directly between said plurality of gates and said plurality of blister compartments, said chads being hidden beneath said gates such that said chads are not visible in said front wall; and and said rear wall of said hollow carton comprising a structure including an exterior wall panel having a plurality of separate, openings and an interior wall panel adhesively secured to said exterior wall panel of said rear wall, said interior wall panel of said rear wall having a plurality of break-through chads directly aligned between said plurality of blister compartments and said plurality of openings.

11. A child-resistant package, comprising:

a hollow carton having opposed, spaced-apart, front and rear walls; and a separate blister card contained within said hollow carton, said blister card having a plurality of separate, spaced-apart hollow blister compartments;

said front wall of said hollow carton comprising a double wall structure including an exterior wall panel having a plurality of separate, spaced-apart peel tabs and an interior wall panel adhesively secured to said exterior wall panel, said interior wall panel of said front wall having a plurality of push tabs aligned directly between said plurality of peel tabs and said plurality of blister compartments; and and said rear wall of said hollow carton comprising a double wall structure including an exterior wall panel having a plurality of separate, openings and an interior wall panel adhesively secured to said exterior wall panel of said rear wall, said interior wall panel of said rear wall having a plurality of break-through chads directly aligned between said plurality of blister compartments and said plurality of openings.

12. The package according to claim 11, wherein said exterior wall panel of said front wall of said carton includes a plurality of openings with one of said openings adjacent each of said peel tabs such that said each of said openings of said exterior wall panel of said front wall permitting a user to grip a free edge of one of said peel tabs so that said peel tab may be peeled away from said front wall of said carton to expose one of said push tabs.

13. The package according to claim 12, wherein each of said push tabs on said interior wall panel of said front wall of said carton is defined by a U-shaped perforation or crease.

14. The package according to claim 13, wherein each of said break-through chads on said interior wall panel of said rear wall is defined by perforations forming an oval and each of said openings on said exterior wall panel of said rear wall being of a shape matching and aligned with said perforations of said break-through chads.

15. A blank for forming a hollow carton, comprising:

an integral sheet of material including major wall panels for forming front wall and rear walls of a hollow carton, minor wall panels for forming side and end walls of the hollow carton, and a plurality of pre-formed creases defining said major and minor wall panels;

said major wall panels including an exterior rear wall panel having a plurality of openings formed therein, an interior rear wall panel connected to an end of said exterior wall panel via a plurality of minor wall panels and creases and having a plurality of break-through chads defined by perforations, an interior front wall panel connected to a side edge of said exterior rear wall panel via a minor wall panel and creases and having a plurality of push tabs or chads defined by perforations, and an exterior front wall panel connected to an opposite side edge of said exterior rear wall panel via a minor wall panel and creases and having a plurality of peel tabs, openings, or gates.

16. The blank for forming a hollow carton according to claim 15, further comprising a one-way flap that extends from an end of said interior front wall panel with a pre-formed crease extending therebetween about which the one-way flap is adapted to pivot.

17. The blank for forming a hollow carton according to claim 15, further comprising a first cover flap panel extending from a side edge of said exterior front wall panel.

18. The blank for forming a hollow carton according to claim 12, wherein said plurality of minor wall panels extending between said exterior rear wall panel and said interior rear wall panel are configured such that, when folded together, a false bottom is formed within the hollow carton.

19. The blank for forming a hollow carton according to claim 12, wherein said integral sheet of material is made of paperboard or solid bleached sulfate paperboard.

* * * * *